United States Patent [19]

Holmström

[11] 4,267,957

[45] May 19, 1981

[54] PACKING CONTAINER AND A LAMINATE FOR ITS MANUFACTURE

[75] Inventor: Sven N. H. Holmström, Löberöd, Sweden

[73] Assignee: Tetra Pak International AB, Lund, Sweden

[21] Appl. No.: 94,496

[22] Filed: Nov. 15, 1979

[30] Foreign Application Priority Data

Nov. 21, 1978 [SE] Sweden ..... 7811982

[51] Int. Cl.[3] ..... B65D 5/08

[52] U.S. Cl. ..... 229/37 R; 229/17 G

[58] Field of Search ..... 229/37 R, 17 G

[56] References Cited

U.S. PATENT DOCUMENTS 2,336,503 12/1943 Ringler ..... 229/17 G X
2,339,820 9/1968 Foster et al. ..... 229/37 R
2,596,225 5/1952 Eaton ..... 229/17 G X
3,185,375 5/1965 Thomas ..... 229/17 G

*Primary Examiner*—Davis T. Moorhead
*Attorney, Agent, or Firm*—Burns, Doane, Swecker & Mathis

[57] ABSTRACT

A laminated packing container with a substantially flat bottom surface is disclosed. The packing container has a plurality of side walls and both a top end wall and a bottom end wall. A plurality of upper and lower corner lugs are located at the intersection of the side walls and the end walls. A crease line which angles in toward the center of the bottom end wall is located between each lower corner lug and the bottom end wall such that upon formation of the packing container the crease line results in a portion of the laminate being displaced into the packing container to permit the bottom surface of the packing container to have an improved flatness.

15 Claims, 4 Drawing Figures

PACKING CONTAINER AND A LAMINATE FOR ITS MANUFACTURE

The present invention relates to a packing container comprising a number of side and end walls together with double-walled substantially triangular corner lugs. The corner lugs are delimited from adjoining walls by means of one or more crease lines extending between corners of the corner lugs, along which the corner lugs are folded down against and attached to an adjoining end wall.

The invention also relates to a packing laminate for the manufacture of a packing container comprising a number of wall panels separated by means of crease lines for the formation of the side walls of the packing container, end wall panels for the formation of the end walls of the packing container and triangular panels for the formation of corner lugs.

A known and frequently encountered packing container for the packaging of e.g. milk is manufactured from a flexible weblike laminate which comprises a central carrier layer of paper which is covered on either side with a thin layer of liquid-tight heat-sealable plastic material, e.g. polyethylene. The laminate is fed to a packing machine in the form of a roll and is converted as it is reeled off successively to tubular form and, at the same time as its longitudinal edges are sealed to one another in a liquid-tight manner, the tube is fed substantially vertically downwards through the packing machine. Contents are supplied to the tube continuously through a pipe which extends into the tube at its upper end. The surface level of the contents is maintained the whole time at a certain level with the help of level-controlling elements. Subsequently, a repeated cross-sealing of the tube takes place below this level by pressing it together at regular intervals with the help of heated sealing jaws, so that the heat-sealable plastic layers of the tube present on its inside join the tube sides together in liquid-tight transverse seals. A web of continuous, substantially cushion-shaped packing containers results. These packing containers are separated from one another by cutting through the said sealing zones, whereupon a further shaping process of the filled cushion-shaped containers imparts to them a final, substantially parallelepipedic shape. In this final shaping process four double-walled corner lugs are produced which are formed of material which for reasons of geometry are not utilized in the formation of the actual parallelepipedic container body. To prevent them from forming an obstruction and interfering with the regular parallelepipedic shape these flattened corner lugs are folded in and sealed to adjoining packing container surfaces. The packing container is then ready.

As is evident from what has been said, cushion-shaped packing containers are produced by transverse sealing and cutting of the filled material tube, which on its upper and lower ends has sealing fins. After conversion of the cushion-shaped container to parallelepipedic shape these sealing fins will extend substantially centrally over the upper and lower end wall of the packing container and the corner lugs adjoining these end walls. The sealing fins thus extend transversely over the end wall of the packing container between the two free corners of the corner lugs connected to the end wall. In connection with the formation of the parallel-epipedic packing container the sealing fins are folded down so that they lie against the material surface to which they are attached. As mentioned previously, the flattened corner lugs are folded down and are attached to adjoining container walls. The two corner lugs situated at the lower end of the packing container are usually folded in against the bottom end of the packing container. This folding is made difficult, however, by the sealing fin which runs over the bottom end as well as over the two corner lugs. On folding of the corner lug to lie against the bottom end of the packing container not only the two material layers which form the actual corner lug, but also the sealing fin formed of two material layers has to be folded over by 180°. Thus it may happen that the corner lug after folding and attachment is no longer completely flat but somewhat bulges outwards. This is, of course, a disadvantage since as a consequence the packing container will fail to stand upright in a satisfactory manner when it is placed on a plane surface.

To overcome this disadvantage and to make possible an easier bending of the multiple thickness of material, the packing laminate at present is usually provided with crease lines which extend between the two corners on each corner lug adjoining the actual wall surfaces of the parallelepipedic packing container. This has been found to facilitate the folding in of the corner lugs, but owing to the multiple thickness of material and the double sealing fins present between the respective corner lug and the side wall, a distinct folding line is still not obtained rather the corner lug after folding presents an outwardly bulging shape.

It is an object of the present invention to provide a packing container wherein the folding of the corner lugs against the wall surface of the packing container is made easier and wherein the corner lugs after folding retain their plane shape.

It is a further object of the present invention to provide a packing container of the aforementioned type, wherein the aforementioned disadvantages are eliminated without any major or expensive conversion of either the packing container or of the packing machines manufacturing the packing container being required.

These and other objects have been achieved in accordance with the invention by a packing container comprising a number of side and end walls together with double-walled, substantially triangular corner lugs. These are delimited from adjoining walls by means of one or more crease lines extending between corners of the corner lugs, and along which the corner lugs are folded down to lie against and be attached to an adjoining end wall. The packing container has been given the characteristic that a crease line situated between a folded-down corner lug and the adjoining wall runs closer to the central part of the end wall than an imaginary straight line traced between the said corners.

It is a further object of the present invention to provide a packing laminate for the manufacture of the packing container described above.

This object has been achieved in accordance with the invention by a packing laminate for the manufacture of a packing container comprising a number of wall panels for the formation of side walls of the packing container, end wall panels for the formation of end walls of the packing container and triangular panels for the formation of corner lugs all separated by crease lines. The packing container has been given the characteristic that an end wall panel is delimited from the adjoining triangular panel by means of crease lines which extend in such direction from a crease line situated between the end wall and the adjoining side wall panel that the end wall panel tapers off in the direction from the said side wall panel.

Preferred embodiments of the packing container as well as of the packing laminate for its manufacture have been given the further characteristics evident from the following description.

A preferred embodiment of the packing container and the packing laminate in accordance with the invention will be described in more detail in the following with reference to the enclosed schematic drawings.

Figure 1:
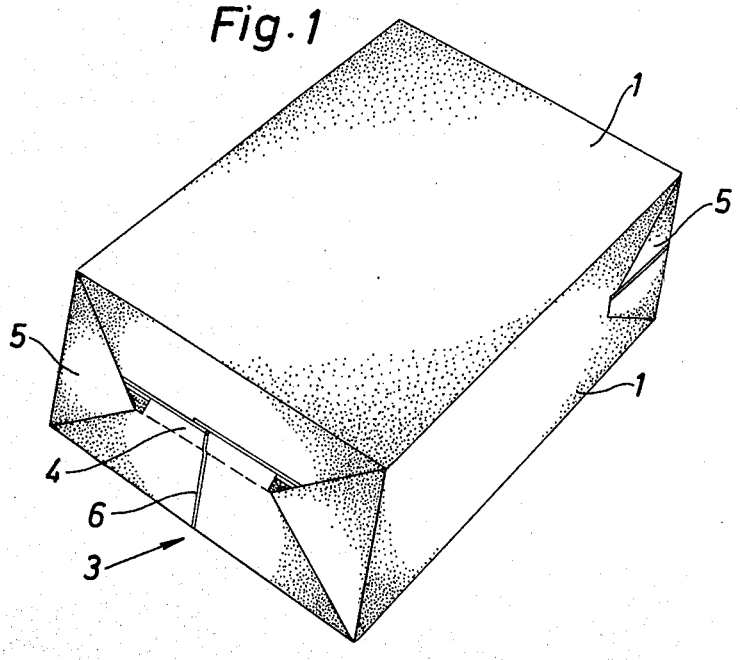
FIG. 1 is a pictorial view of a packing container in accordance with the invention.

The packing container shown in FIG. 1 comprises four substantially rectangular side walls (only two of which are visible in the figure) and two also substantially rectangular end walls 3 (only one of which is visible in the figure). The packing container is manufactured from a flexible, relatively rigid, weblike laminate which has been formed into a tube. The tube through flattening and cross-sealing at regular intervals has been closed in transverse narrow zones. After cutting also transversely through the said zones, cushion-shaped packing containers are obtained which at their upper end lower ends have sealing fins which during the subsequent forming of the packing containers to a substantially parallelepipedic shape come to be situated on the upper and lower end of the packing container where the said sealing fins indicated by reference numeral 4 extend transversely over the respective end walls 3. The sealing fins 4 have been folded down in connection with the forming of the packing container so as to lie against the material surface to which they are connected.

During the forming process which is required for the conversion of the substantially cushion-shaped packing container to the parallelepipedic shape shown, four substantially triangular double-walled corner lugs 5 (only three of which are visible in the figure) are also formed. The corner lugs are folded over along the straight wall edges along which they are connected to the actual parallelepipedic packing container and are fixed by means of heat-sealing to the wall of the packing container. FIG. 1 finally also illustrates a longitudinal seal 6 which during the formation of the tube has been formed by the two longitudinal edges of the material web overlapping one another. The seal 6 extends between the two sealing fins and thus runs over one side wall 1 and partly also over the two end walls 3.

Figure 2:
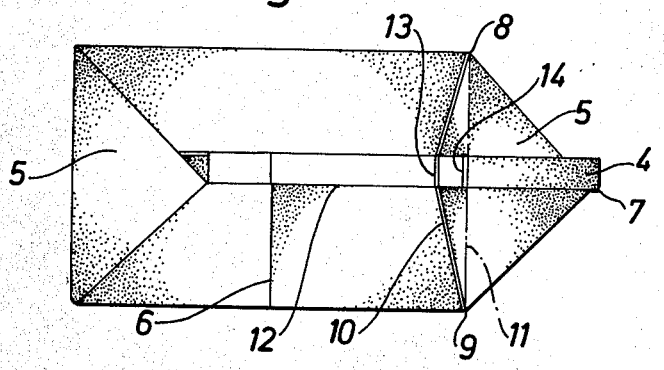
FIG. 2 is a bottom view of the bottom end wall of the packing container in accordance with FIG. 1, a corner lug being shown in non-folded position.

FIG. 2 shows the packing container in accordance with FIG. 1 from underneath. In the packing container shown one of the two corner lugs situated at the short edges of the end wall 3 has not yet been folded in and attached to the bottom wall surface. This illustrates clearly how the sealing fin 4 running over the end wall 3 extends over the one side of the corner lugs 5 to terminate at the free corner 7 of the corner lug remote from the end wall 3.

When the corner lug 5 which has not yet been folded in is to be folded so as to be attached to the end wall 3 like the opposite corner lug, not only the corner lug consisting of double material layers must be folded over 180°, but also the sealing fin, extending over the corner lug and the end wall 3, which also consists of double material layers. To facilitate this folding of the multiple thickness of material over 180°, the packing container in accordance with the invention has been provided with a weakening or crease line 10 running between the two corners 8 and 9 of the corner lug 5 adjoining the end wall. The crease line 10, does not, however, run along the "natural" straight folding line which connects the two corners 8 and 9 (this imaginary line is illustrated by means of dash-dotted line 11 in FIG. 2). Instead the crease line 10 runs more closely to the central part of the end wall 3 than the imaginary straight line 11. More particularly this means that the crease line 10 crosses the sealing fin 4 at a point which in relation to the crossing point of the sealing fin 4 and the said imaginary line 11 is displaced in direction towards the central part of the end wall 3. As can be seen from FIG. 2, the crease line 10 actually consists of two parts, namely one line situated on either side of the sealing fin 4 which meet on the sealing fin where they form an obtuse angle with one another. At the meeting point of the two parts of the crease line 10, an auxiliary crease line 13 extends at the foot line 12 of the sealing fin forming a right angle with the foot line 12 over the sealing fin 4. A further auxiliary crease line 14 extends (also right-angled to the foot-line 12) over the sealing fin 4 at some distance from the auxiliary crease line 13, namely substantially along the imaginary folding line 11.

Figure 3:
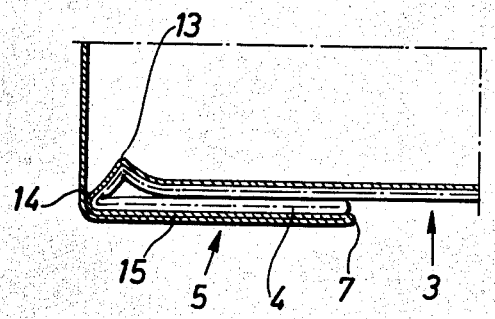
FIG. 3 is a section through a part of the packing container of FIGS. 1 and 2 and shows on a larger scale a corner lug folded against the end wall.

FIG. 3 is a section along a part of a sealing fin 4 on the packing container according to FIGS. 1 and 2 and shows on a larger scale how a folded corner lug 5 rests against the end wall 3 of the packing container. It is evident from the figure how the corner lug 5 comprises on the one hand a double material layer 15, on the other hand, the sealing fin 4, which likewise consists of double material layers. The corner lug is attached to the end wall by heat-sealing in a limited area near the outer corner 7 of the corner lug. The material layers forming corner lug 5 and end wall 3 are folded along the crease line 10 and the figure illustrates how the sealing fin 4 and the adjoining material layer have been folded or bent along the two auxiliary crease lines 13, 14 (the auxiliary crease line 13 substantially coincides with the crease line 10). The placing of the crease line 10 at some distance inside the "natural" folding line means that on folding down of the corner lug 5 against the end wall of the packing container the bend or folding of the material layers takes place first along the said crease line 10 so that this portion of material is shifted inwards into the packing container before the folding guided by the "natural" folding line commences. Since a part of the material of the end wall 3, namely the area situated along the crease line, has been slightly displaced inwards into the packing container, the continued folding along the "natural" folding line can take place without obstruction so that a correct, rectangular folding down of the corner lug can take place without the latter losing its flatness and starting to bulge outwards in the area between the folding line and the corner 7. This has not been possible hitherto because the accumulation of material, now shifted towards the interior of the packing container along the folding line, previously meant that the folding became unsharp and undefined and that the corner lug acquired an outwardly buckled shape.

Figure 4:
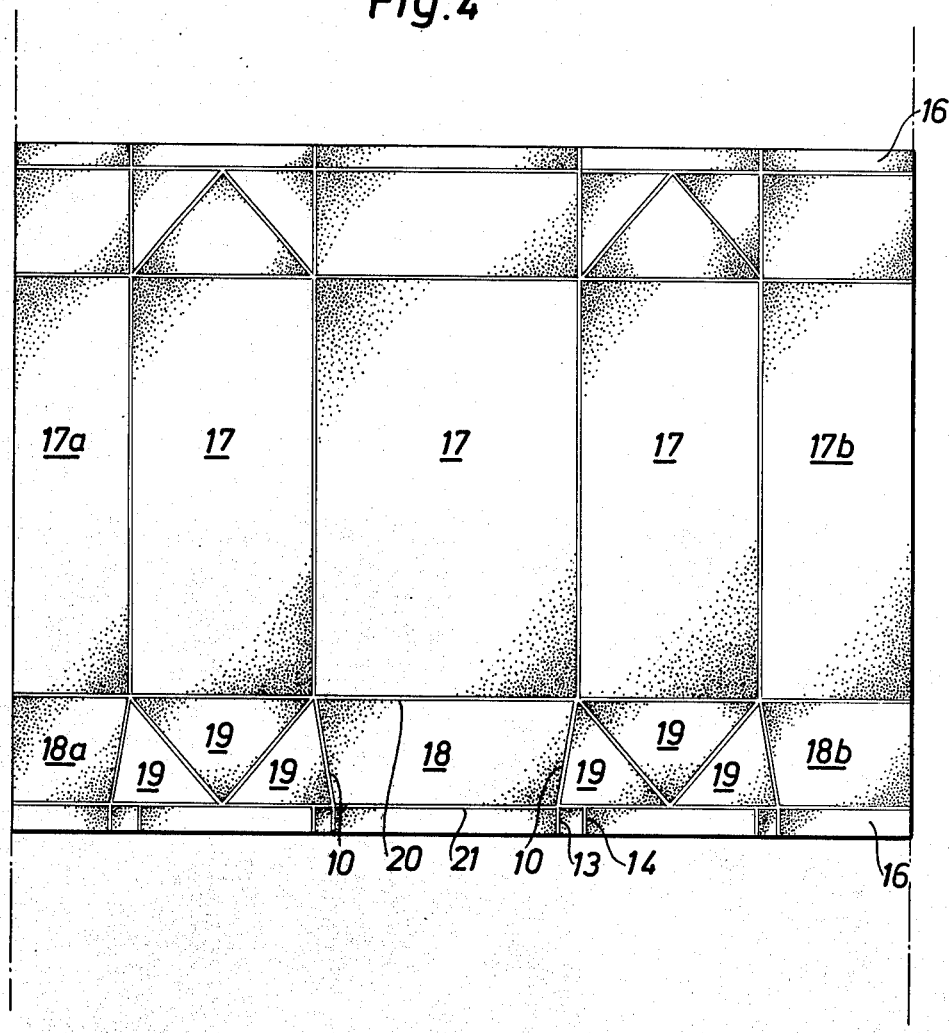
FIG. 4 is a top view of a packing laminate blank provided with crease lines for the manufacture of a packing container in accordance with FIG. 1.

A preferred embodiment of a packing laminate for the manufacture of the packing container in accordance with the invention will now be described in more detail with special reference to FIG. 4, which shows a laminate blank provided with crease lines for the manufacture of a packing container of the type which is shown in e.g. FIG. 1. The laminate blank shown is joined to laminate blanks of exactly the same kind, so that a packing material web is formed which extends upwards and downwards in FIG. 4 (indicated by means of dash-dotted lines). The packing laminate comprises several material layers, namely a central, relatively thick layer of paper and on either side of this laminated thin layers of thermoplastic material.

The laminate is provided with a pattern of crease lines constituting folding markings which facilitate the conversion of the laminate to a parallelepipedic packing container. The figure illustrates how the laminate blank on its upper and lower edge has narrow sealing panels 16 delimited by means of crease lines, which correspond to the sealing fins 4 in the finished packing container. The two opposite edges of the packing laminate which do not have such panels 16 constitute the two longitudinal edges of the packing material web and they are adapted so that after the folding of the packaging material web to tubular shape they partly overlap one another and are sealed together so as to form the longitudinal seal 6 of the material tube.

The packing laminate moreover has four rectangular sidewall panels 17 corresponding to the side walls 1. Before the conversion of the laminate to tubular shape, one of the side walls is divided into two parts 17*a*, 17*b*, which are situated at the two outer edges of the laminate. The packing laminate furthermore has a number of end wall panels which are situated along the two panels 16 forming the sealing fins. The bottom end wall 3 of the packing container is formed by two end wall panels 18, one of which is divided into two panel portions 18*a* and 18*b* situated along the longitudinal edges of the material web. Between the end wall panels 18 are a number of triangular panels 19 which adjoin the end wall panels 18 as well as the side wall panels 17 and the panels 16 forming the sealing fins 4. After the conversion of the packing laminate to parallelepipedic packing containers the triangular panels 19 form the four corner lugs 5. Both the triangular panels 19 and the end wall panels 18 have their counterpart on the opposite edge of the packing laminate provided with sealing panels 16. The panels situated along the lower edge of the packing laminate are of a somewhat different appearance. This is due to the crease lines 10 situated between the panels being traced in a different way, which will be explained in more detail in the following.

Each of the end wall panels 18, which are to form the lower end wall 3 or bottom of the finished packing container, is delimited from the neighboring triangular return-folding panel 19 by means of crease lines 10. These crease lines 10 run, as seen from the end wall panel 18, at an acute angle from a crease line 20 delimiting the end wall panel from the adjoining side wall panel 17, and more particularly the two crease lines 10 extend in such a direction from the crease line 20 that the end wall panel 18 tapers off in the direction from the adjoining side wall panel 17. In the embodiment of the packing container shown in FIGS. 1, 2 and 3 the end walls are divided into two panels by the sealing fin 4 running over the end wall as well as over the adjoining corner lugs. In a preferred embodiment of the packing laminate each end wall will therefore be matched by two parallel-trapezoidal end wall panels 18 delimited by means of crease lines. These panels are connected by their longer parallel crease lines 20 to the adjoining side wall panel 17. In corresponding manner the parallel trapezoidal end wall panels 18 are connected by their shorter parallel crease lines to the sealing fin 4 or more accurately to the sealing panel 16 forming the sealing fin 4.

The crease lines 10 which delimit the respective end wall panels 18 from the adjoining triangular return-folding panels 19 are constituted preferably as straight crease lines which form an angle of 75°–88° with the longer (20) of the two parallel limiting or crease lines 20, 21.

As mentioned earlier in connection with FIG. 2, two auxiliary crease lines 13, 14 extend transversely over the sealing fin 4 so as to facilitate further the folding of the same. Such an auxiliary crease line 13 is arranged at the same level as each corner of the parallel-trapezoidal end wall panel 18 adjoining the sealing fin 4, while a second auxiliary crease line 14 extends transversely over the sealing fin 4 at the same level as the corners of the parallel-trapezoidal end wall panels adjoining the side wall panel 17 of the packing container.

The end wall panels situated along the upper sealing panel 16 are delimited from triangular return-folding panels situated in between by means of conventionally designed crease lines which constitute rectilinear continuations of the crease lines situated between the side wall panels 17. This is due to the fact that the two corner lugs 5 on the packing container shown (FIG. 1) are folded outwards and are attached to adjoining side wall panels 17 instead of to the end wall panel. This means that the folding work is simplified, since the sealing fin will come to be situated on the outside of the corner lug instead of on its inside and thus does not form an obstruction in the same manner as it does on the lower end wall of the packing container.

The difficulties in the folding of corner lugs mentioned in the introduction are thus overcome in accordance with the invention through an alteration of the pattern of crease lines used conventionally. The displacement of the crease line to a position somewhat to the side of the natural folding line has allowed an unobstructed folding of the corner lugs to the desirable plane position lying against the end wall.

Naturally, it is also possible to use the invention in other packing containers where corresponding problems exist. Moreover, the extent and shape of the actual crease line may be varied within wide limits; the line may be made curved, for example, or it may consist of three or more partial lines which run at an angle to each other.

The expression crease line is to be understood in the description and claims to mean a line which through weakening of the material facilitates folding of the same. Crease lines of varying style may exist therefore, e.g. punched lines which partially cut through the material, and broken or intermittent lines.

The principles, preferred embodiments and modes of operation of the present invention have been described in the foregoing specification. The invention which is intended to be protected herein should not be construed as limited to the particular forms disclosed, since these are to be regarded as illustrative rather than restrictive. Variations and changes may be made by those skilled in the art without departing from the spirit of the invention.

What is claimed is:

1. A packing container, comprising:

a first end wall having first, second and third consecutive edges with a first corner defined by the first and second edges and a second corner defined by the second and third edges;

a first wall joined to the first end wall along said first edge;

a second wall both joined to the first wall and connected to the second edge of the first end wall between said first and second corners by a corner lug;

a third wall both joined to the second wall and joined to the first end wall along said third edge;

said corner lug having a first crease line which extends between a central portion of the first end wall and an imaginary straight line between said first and second corners; and a sealing fin extending both over the first end wall and the corner lug, said sealing fin being connected both to the first end wall and to the corner lug, said first crease line crossing the sealing fin between a central portion of the sealing fin of the first end wall and a portion of the sealing fin crossing said imaginary straight line between said first and second corners.

2. The packing container of claim 1 wherein said first crease line includes first and second portions which meet on the sealing fin at an obtuse angle.

3. A packing container, comprising:

a first end wall having first, second, third and fourth adjacent edges with a first corner defined by the first and second edges, a second corner defined by the second and third edges, a third corner defined by the third and fourth edges and a fourth corner defined by the fourth and first edges;

a first wall joined to the first end wall along said first edge;

a second wall both joined to the first wall and connected to the second edge of the first end wall between said first and second corners by a first corner lug;

a third wall both joined to the second wall and joined to the first end wall along said third edge;

a fourth wall joined to the first and third walls and connected to the fourth edge of the first end wall between said third and fourth corners by a second corner lug;

said first and second corner lugs each being double walled and substantially triangular with each of said corner lugs being folded down against the first end wall and attached to the first end wall;

said first corner lug having a first crease line which extends between a central portion of the first end wall and a first imaginary straight line between said first and second corners;

said second corner lug having a second crease line which extends between said central portion of the first end wall and a second imaginary straight line between said third and fourth corners.

4. The packing container of claim 3 further comprising:

a sealing fin extending over the first end wall and said first and second corner lugs, said sealing fin being connected to the first end wall and to said first and second corner lugs.

5. A rectangular packing container, comprising:

first through fourth consecutive side walls each joined to one another;

an end wall joined to the first and third side walls along straight crease lines, the end wall joined to the second side wall by a first corner lug and joined to the fourth side wall by a second corner lug;

said first corner lug being joined to the second side wall along a straight crease line and being joined to the end wall along a non-linear crease line;

said second corner lug being joined to the fourth side wall along a straight crease line and being joined to the end wall along a non-linear crease line.

6. A packing laminate for the manufacture of a packing container, comprising:

first, second and third adjacent side panels, said first and second side panels being joined to one another along a first crease line, said second and third side panels being joined to one another along a second crease line;

a first corner lug panel joined to the first side panel along a third crease line;

a first end panel joined to the second side panel along a fourth crease line, said first end panel and said first corner lug panel being joined along a fifth crease line;

a second corner lug panel joined to the third side panel along a sixth crease line, said second corner lug panel and said first end panel being joined along a seventh crease line;

said fifth and seventh crease lines being non-parallel.

7. The packing laminate of claim 6, wherein said fifth and seventh crease lines each form acute angles with said fourth crease line.

8. The packing laminate of claim 6 wherein said first end panel is trapezoidal.

9. The packing laminate of claim 6 wherein said third, fourth and sixth crease lines are colinear.

10. The packing laminate of claim 9 wherein a sealing fin extends along said first corner lug panel, said first end panel and said second corner lug panel.

11. The packing laminate of claim 7 wherein said acute angles are identical.

12. The packing laminate of claim 11 wherein said acute angles are within the range including 75° to 88°.

13. The packing laminate of claim 10 wherein said sealing fin includes both an eigth crease line adjacent said fifth crease line and parallel with said first crease line and a ninth crease line adjacent said seventh crease line and parallel with said second crease line.

14. The packing laminate of claim 13 wherein said sealing fin includes both a tenth crease line colinear with the first crease line and an eleventh crease line substantially colinear with the second crease line.

15. The packing laminate of claim 6 wherein each of said corner lug panels is trapezoidal.

* * * * *